US005796043A

United States Patent [19]

Maruyama

[11] Patent Number: 5,796,043

[45] Date of Patent: Aug. 18, 1998

[54] HIGH-TENSION CABLE

[75] Inventor: Masaru Maruyama, Gotenba, Japan

[73] Assignee: Yazaki Corporation, Tokyo, Japan

[21] Appl. No.: 780,301

[22] Filed: Jan. 8, 1997

[30] Foreign Application Priority Data

Jan. 9, 1996 [JP] Japan ..... 8-001484

[51] Int. Cl.[6] ..... H01B 7/00

[52] U.S. Cl. ..... 174/102 SC; 174/122 G; 174/126.4

[58] Field of Search ..... 174/126.4, 122 R, 174/122 G, 124 R, 124 G, 120 R, 102 C, 102 SC

[56] References Cited

U.S. PATENT DOCUMENTS 4,241,427 12/1980 Swenson ..... 367/20
5,057,812 10/1991 Yukawa et al. ..... 174/120 R X
5,628,756 5/1997 Barker, Jr. et al. ..... 606/139

FOREIGN PATENT DOCUMENTS 50-141781 11/1975 Japan ..... H01B 1/00
2-12680 4/1990 Japan ..... H01R 4/70

*Primary Examiner*—Kristine L. Kincaid
*Assistant Examiner*—Marc D. Machtinger
*Attorney, Agent, or Firm*—Sughrue, Mion, Zinn, Macpeak & Seas, PLLC

[57] ABSTRACT

A high-tension cable including a metallic resistance wire wound around a reinforcing core, an insulator covering the metallic resistance wire, a braid covering the insulator, and a jacket covering the braid, wherein the reinforcing core has a hollow cylindrical braiding structure so as to increase pliability of the reinforcing core. In the high-tension cable, the reinforcing core can be easily folded with flexibility in crimping a terminal to prevent much stress on the metallic resistance wire around the reinforcing core from being caused and to prevent the metallic resistance wire from breaking.

4 Claims, 4 Drawing Sheets

HIGH-TENSION CABLE

BACKGROUND OF THE INVENTION

1. Field of the Invention

The present invention generally relates to a high-tension cable, and particularly to a high-tension noise-preventing cable for preventing noise wherein flexibility (pliability) of a reinforcing core in the center of the cable is increased, breaking of a metallic resistance wire is prevented and adherence of a terminal is increased when the terminal is crimped.

2. Description of the Related Art

FIG. 4 shows a conventional high-tension cable.

This high-tension cable 11 is constituted by a reinforcing core 14 in which fibers 12 such as glass or KEVLAR (high-strength fibers with high elastic modulus) are twisted together and covered with rubber 13 by coating or extrusion as shown in an enlarged view, a metallic resistance wire 4 wound spirally around the reinforcing core 14, an insulator 5 of silicon rubber or the like having heat resistance and insulating property and covering the metallic resistance wire 4, a braid 6 of glass fibers or the like formed on the surface of the insulator 5, and a jacket 7 of rubber covering the braid 6.

As shown in FIGS. 5 and 6, a conductive core 15, which is the reinforcing core 14 wound with the metallic resistance wire 4, is folded back along the jacket 7 and crimp-connected by a pair of crimping chips 16 of a terminal metal fitting 9. In other words, the metal resistance wire 4 is put between a bottom portion 16*a* of the crimping chips 16 and the jacket 7 and contacts the bottom portion 16*a* of the crimping chips 16.

In the conventional high-tension cable 11 mentioned above, however, the reinforcing core 14 tends to be broken when the reinforcing core 14 and the metallic resistance wire 4 constituting the conductive wire 15 are folded as shown in FIG. 5. This may damage the metallic resistance wire 4, and at worst, the metallic resistance wire 4 may be broken. Therefore, the crimping chips 16 of the terminal 9 can not be fasten so strongly (that is, a clamp height C/H shown in FIG. 6 can not be made small), and hence adherence of the cable terminal by crimping can not be made so strong.

On the other hand, FIG. 7 shows a high-tension cable 18 disclosed in Japanese Utility Model Unexamined Publication No. Sho. 50-141781, in which a solid reinforcing core 19 is formed using twisted yarns of glass fibers. A semi-conducting silicon-cover layer 20 is formed around the solid reinforcing core 19 to constitute a conductive core 21. In this example, however, the reinforcing core 19 may not be pliable enough to solve the same problem as mentioned above when the reinforcing core 19 is folded.

SUMMARY OF THE INVENTION

It is an object of the present invention to provide a high-tension cable in which a reinforcing core and a metallic resistance wire are prevented from breaking in crimp-connecting the cable terminal and in which adherence of the terminal is increased by crimping the terminal with strong force.

In order to attain the above object, according to the present invention, there is provided a high-tension cable comprising: a reinforcing core; a metallic resistance wire wound around the reinforcing core; an insulator covering the metallic resistance wire; a braid covering the insulator; and a jacket covering the braid, wherein the reinforcing core has a hollow cylindrical braiding structure so as to increase pliability of the reinforcing core.

DETAILED DESCRIPTION OF THE PREFERRED EMBODIMENT

An embodiment of the present invention will be described in detail by using the accompanying drawings.

Figure 1:
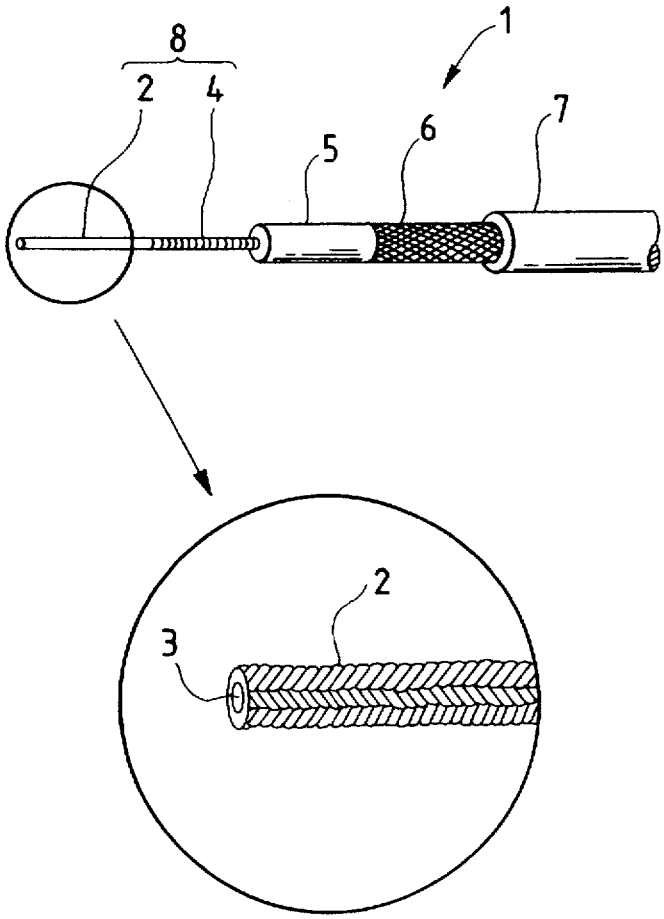
FIG. 1 is a perspective view showing an embodiment of the high-tension cable according to the present invention.

FIG. 1 shows an embodiment of the high-tension cable according to the present invention.

This high-tension cable 1 has a feature in which a reinforcing core 2 is covered with cylindrically braided fibers, such as glass fibers, high-strength fibers with a high elastic modulus, such as "KEVLAR" fibers or the like, so as to form a hollow part 3 inside the reinforcing core 2 as shown in an enlarged view. "Cylindrical braiding" means braiding threads into a hollow braid. A metallic resistance wire (nickel-chromium wire) 4 is wound spirally around the reinforcing core 2 in the same way as in the conventional cables, the metallic resistance wire 4 is covered with an insulator 5 such as silicon rubber or the like, a braid 6 made of glass fibers or the like is formed on a surface of the insulator 5, and the braid 6 is covered with a jacket 7 made of rubber. The hollow reinforcing core 2 and the metallic resistance wire 4 constitute a conductive core 8. The cylindrical braiding structure provides flexibility and preferable pliability to the reinforcing core 2.

Figure 2:
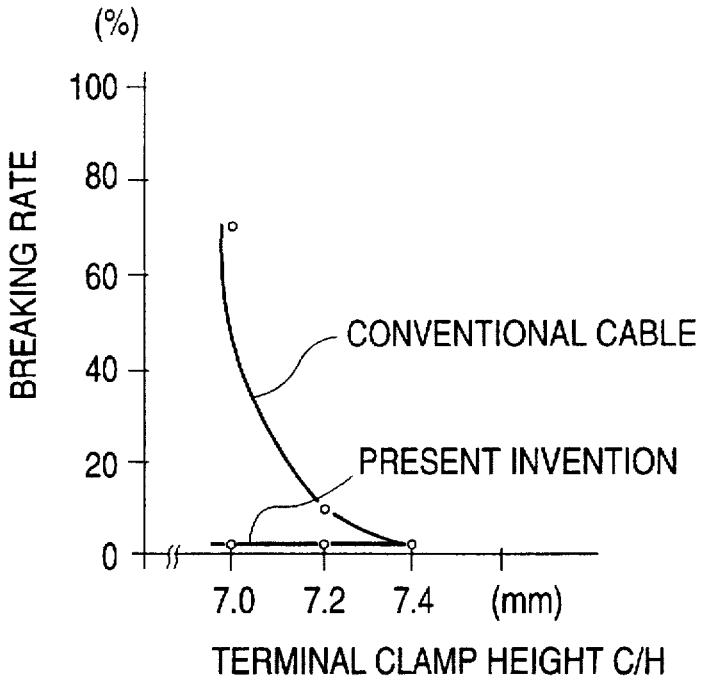
FIG. 2 is a graph showing a result of comparison between the cable of the present invention and a conventional one with respect to the relationship between a terminal clamp height C/H and a cable breaking rate.
Figure 4:
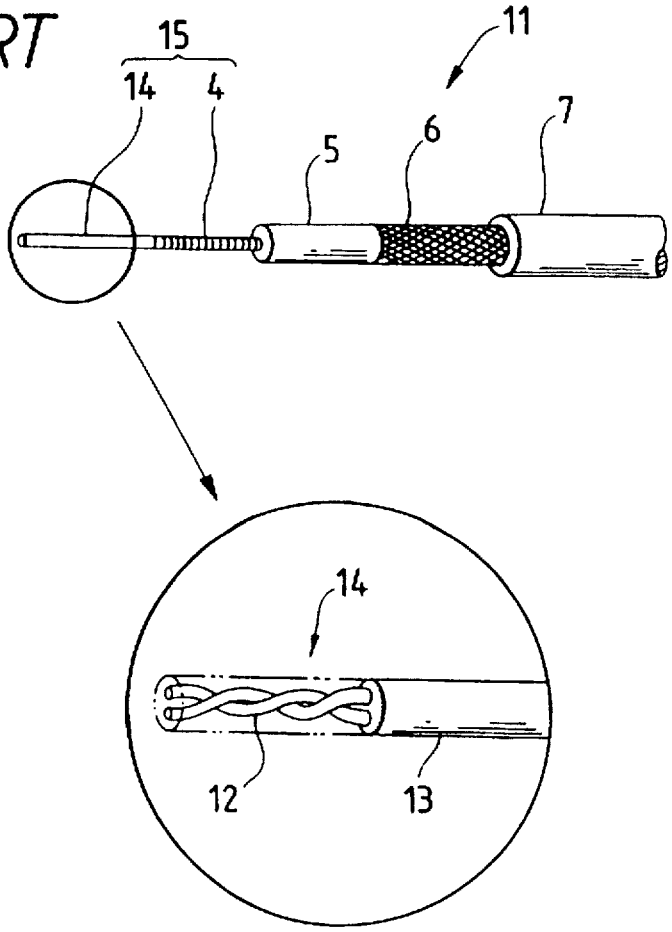
FIG. 4 PRIOR ART
FIG. 4 is a perspective view showing a conventional cable.
Figure 6:
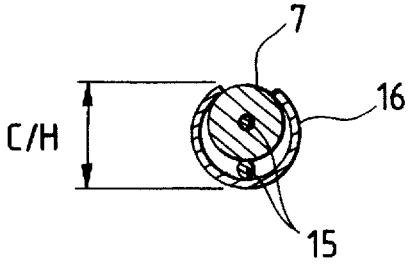
FIG. 6 PRIOR ART
FIG. 6 is a sectional view taken along a line A—A in FIG. 5.
Figure 7:
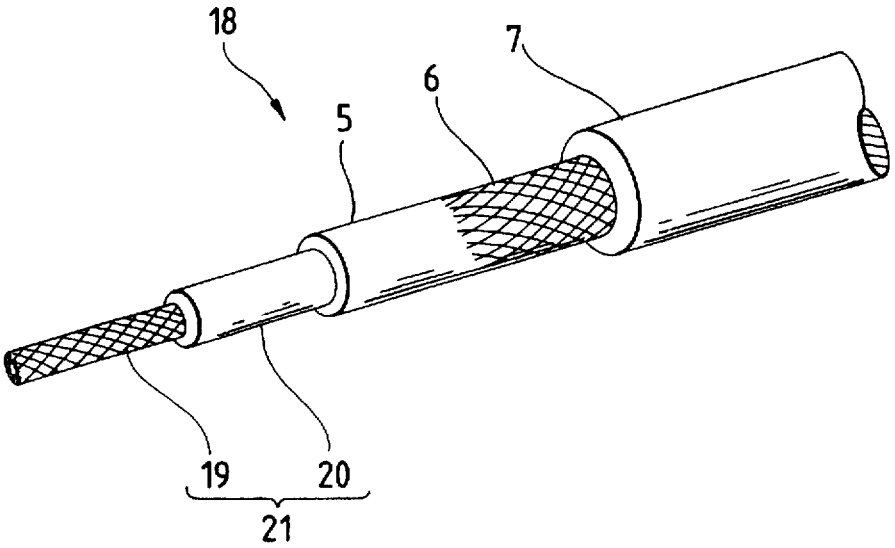
FIG. 7 PRIOR ART
FIG. 7 is a perspective view showing another conventional cable.

FIG. 2 shows a result of examination effected on a relationship between a terminal clamp height C/H (see FIG. 6) in crimping the terminal and a breaking rate of the metallic resistance wire 4 of both the present invention and the conventional cable (FIG. 4).

According to this examination, when the clamp height (C/H) in crimping the terminal is 7.4 mm or less in the conventional high-tension cable, the reinforcing core breaks and the breaking rate of the metallic resistance wire 4 increases considerably, and when the clamp height is 7.0 mm or less, the metallic resistance wire 4 breaks at almost 100%. In the high-tension cable 1 of the present invention, on the other hand, the breaking rate of the metallic resistance wire 4 is extremely low and substantially constant in a range of the C/H from 7.0 mm to 7.4 mm.

Figure 3:
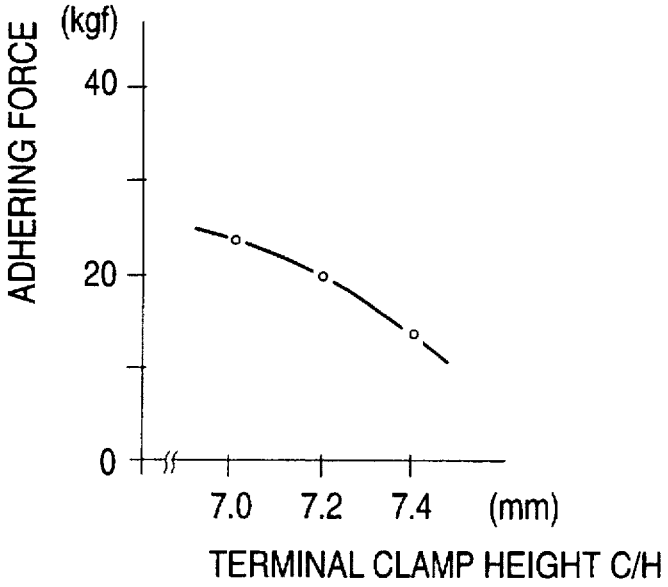
Fig. 3 is a graph showing the relationship between a terminal clamp height C/H and a cable adhering force.

FIG. 3 shows a relationship between the C/H of the terminal and the adhering force of the cable terminal in the present invention (this relationship holds for the conventional cable, too).

According to this graph, in a range of the C/H from 7.0 mm to 7.4 mm, the adhering force decreases almost inversely proportionally from 24 kg to 15 kg. In the conventional cable, when the C/H is 7.4 mm which is the smallest value in practical use (if the C/H is less than 7.4 mm, the metallic resistance wire 4 tends to break), the adhering force is 15 kg. In the present invention, on the other hand, when the C/H is selected to be 7.0 mm, the adhering force is 24 kg which is 1.6 times as long as that in the conventional cable.

Figure 5:
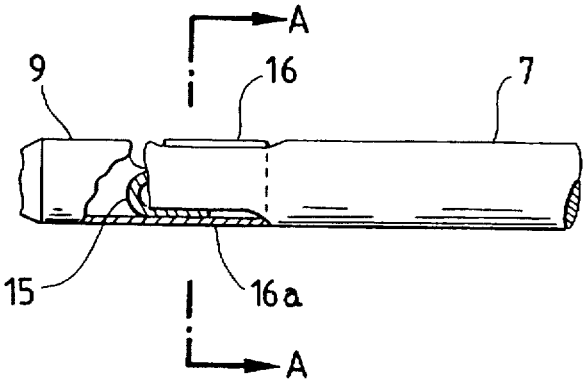
FIG. 5 PRIOR ART
FIG. 5 is a partly cut-away side view showing a cable end crimped to a terminal.

All these effects result from a hollow cylindrical braiding structure of the reinforcing core 2. In other words, since flexibility and pliability of the reinforcing core 2 increase, stress on the metallic resistance wire 4 decreases, and the breaking rate of the metallic resistance wire 4 decreases. Further, since pliability of the reinforcing core 2 increases and stress on the metallic resistance wire 4 decreases, the crimping force (fastening force) of the terminal metal fitting 9 (FIG. 5) increases.

As described above, according to the present invention, since the reinforcing core can be easily folded with flexibility in crimping the terminal, too much stress on the metallic resistance wire around the reinforcing core can be avoided, and the metallic resistance wire is prevented from breaking. Further, the crimping force of the terminal metal fitting can be increased, the adhering force of the cable terminal increases, the terminal is prevented from sudden coming off, the contact pressure of the metallic resistance wire increases, and the reliability of electrical connection increases.

What is claimed is:

1. A high-tension cable comprising:

a reinforcing core;

a metallic resistance wire wound around said reinforcing core;

an insulator covering said metallic resistance wire;

a braid covering said insulator; and a jacket covering said braid, wherein said reinforcing core has a hollow cylindrical braiding structure so as to increase pliability of said reinforcing core.

2. The high-tension cable according to claim 1, wherein said hollow cylindrical braiding structure comprises cylindrically braided fibers.

3. The high-tension cable according to claim 2, wherein said fibers are glass fibers.

4. The high-tension cable according to claim 2, wherein said fibers are formed of material having a high-strength fiber with a high elastic modulus.

* * * * *